United States Patent [19]

Marshall

[11] Patent Number: 4,698,620

[45] Date of Patent: Oct. 6, 1987

[54] FLUID-CONTAINING SECURITY DEVICE

[76] Inventor: Steven G. Marshall, 70 Chestnut Ct., Belle Mead, N.J. 08502

[21] Appl. No.: 793,584

[22] Filed: Oct. 31, 1985

[51] Int. Cl.[4] ..... G08B 13/18; G08B 13/06; G08B 1/00; G08B 5/40

[52] U.S. Cl. ..... 340/568; 116/5; 116/75; 116/211; 116/214; 340/572; 340/691

[58] Field of Search ..... 340/572, 571, 568, 691; 116/201, 206, 214, 211, 4, 75

[56] References Cited

U.S. PATENT DOCUMENTS

| | | | |
|---|---|---|---|
| 2,675,776 | 4/1954 | Tuve | 116/211 |
| 3,596,265 | 7/1971 | Garland | 340/568 |
| 3,725,895 | 4/1973 | Haynes | 116/214 |
| 4,055,277 | 10/1977 | Fegley et al. | 116/75 |
| 4,187,509 | 2/1980 | Weiner | 340/572 |
| 4,267,553 | 5/1981 | Vogelsanger et al. | 340/691 |
| 4,603,326 | 7/1986 | Freed | 340/632 |
| 4,649,397 | 3/1987 | Heaton et al. | 116/211 |

*Primary Examiner*—Glen R. Swann, III

*Attorney, Agent, or Firm*—Kenneth P. Glynn

[57] ABSTRACT

The present invention involves a multiple protection security device which is used to prevent and/or detect burglary of articles, particularly of consumer goods and the like. In one embodiment, the present invention is a remote signal-actuating device for attachment to articles which includes a fluid-containing member which releases detection fluid in response to a predetermined force. In a second embodiment, an electronic security device includes such a fluid-containing member, and, in a third embodiment, a security device for physically restraining an article includes such a fluid-containing member. The detection fluid may be a gas, a liquid or a mixture of these and it may be a coloring agent, an odor containing fluid, a flourescent or phosphorescent dye, a radioactive material or the like.

5 Claims, 8 Drawing Figures

FLUID-CONTAINING SECURITY DEVICE

BACKGROUND OF THE INVENTION

1. Field of the Invention

The present invention is directed to security devices, and more particularly multiple protection security devices. Thus, the present invention is a security device which combines the heretofore single protection security device, e.g. remote signal device, electronic circuit device or physical restraining device, with a secondary "layer" of protection utilizing identifying fluids which "mark" the goods and/or thief when the security device is breached.

2. Prior Art Statement

The types of security devices utilizing remote signal systems such as electromagnetics or radio signalling, metal detector signalling, radioactivity signalling, etc. which set off alarms when passed through detectors are acknowledged as known and constitute entire collections of prior art. Likewise, electronic circuitry systems which set off alarms when "the wires are cut" are also well known, as are physical restraining systems, i.e. chains, wires, strong plastic cording. However, the prior art does not teach these in combination with identifying fluids as in the present invention, more fully set forth below.

The prior art which pertains to fluid identifiers is examplified as follows:

U.S. Pat. No. 4,226,194 to Gahn describes a chemical labelling mixture and methods for identifying a thief and stolen articles. The methods require actively spraying or otherwise applying the chemicals to the stolen money and/or thieves, or passive (automatic) spraying but not in conjunction with an alarm system or physical restaining system.

U.S. Pat. Nos. 4,062,303 to Fegley, 4,024,986 to Fegley and 3,805,732 to Reed all teach "booby trap" type anti-burglar systems involving spray or other release of a deterent fluid, such as tear gas, and Reed superfically teaches this in conjunction with an audible alarm. However, these are used at every window and door entrance to typically deter thieves from entering, e.g. when no one is at home. These systems cannot be used for commercial operations involving retail sales where consumers enter and leave freely, nor would tear gas be safe in such environments.

U.S. Pat. No. 3,730,110 to Peters sets forth a money spray apparatus for spraying a theft identification fluid onto bills. It requires actuation and is not used in a multiple protection system.

U.S. Pat. No. 1,923,979 to Howett describes a liquid projection device embedded or hidden in a stack of bills. The teller squeezes the device to project tear gas or the like into the face of the thief. This device requires presence of and action by an employee at the time of theft and thus face to face confrontation between an employee and a thief. It cannot be used as a passive system in the protection of consumer goods as the present invention is used.

U.S. Pat. No. Re 27,618 to Robeson teaches an electronically actuated robbery protection system which temporarily disables a robber and visibly marks his location. It does not operate in a multiple protection system and has a time delay which activates the explosion some time after the thief has left the premises.

U.S. Pat. No. 2,474,271 to Meyer teaches application of a radioactive material to objects to be protected and not to be removed. Upon removal, geiger counters detect the radioactivity and set off an alarm. It is not a multiple protection system and apparently exposes the radioactivity to everyone who comes into contact with the protected goods or documents, be it thief, employee or otherwise.

Thus, the prior art does teach the use of marking fluids in conjunction with theft detection but not in conjunction with physical restrainers, electronic devices and remote signal devices to create multiple protection on consumer and similar goods.

BRIEF SUMMARY OF THE INVENTION

The present invention involves a multiple protection security device which is used to prevent and/or detect burglary of articles, particularly of consumer goods and the like. In one embodiment, the present invention is a remote signal-actuating device for attachment to articles which includes a fluid-containing member which releases detection fluid in response to a predetermined force. In a second embodiment, an electronic security device includes such a fluid-containing member, and, in a third embodiment, a security device for physically restraining an article includes such a fluid-containing member.

BRIEF SUMMARY OF THE DRAWINGS

The present invention is more readily understood, and alternative embodiments recognized, when considered in conjunction with the drawings, wherein.

DETAILED DESCRIPTION OF THE INVENTION AND DRAWINGS

Figure 1:
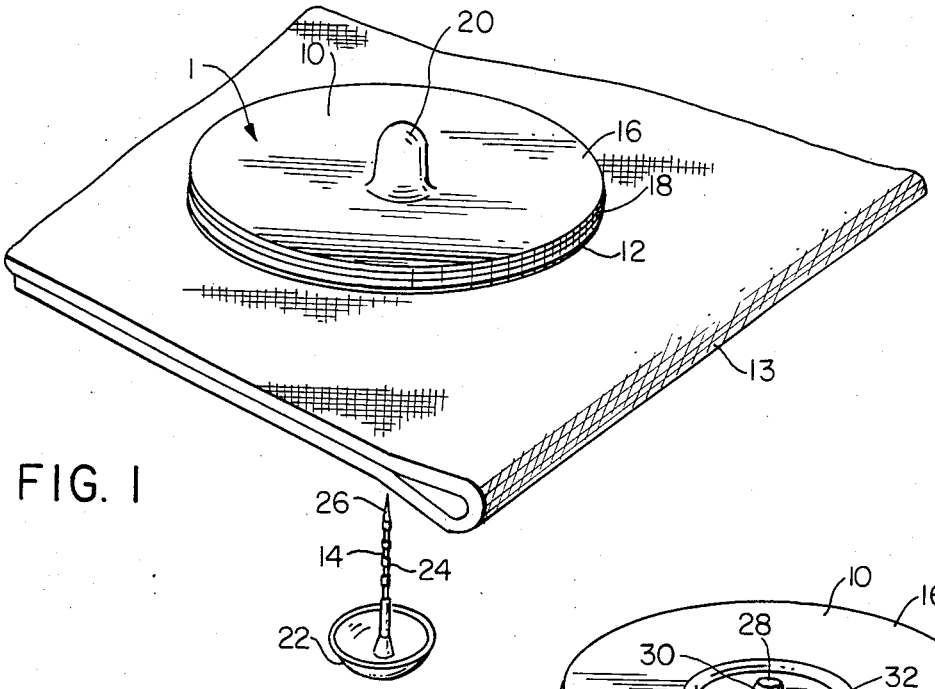
FIG. 1 illustrates an embodiment of the present invention security device of the "pin and badge" type remote signal-actuating device with a fluid-containing member.

FIG. 1 shows a remote signal-actuating security device of the present invention, generally illustrated as device 1. There are three basic components, namely, pin member 14, pin-receiving member 10 and fluid-containing member 12.

As shown in FIG. 1 pin-receiving member 10 is arranged to be fastened to an article of merchandise 13 by means of a pin member 14 which, in this case, is a tack-like fastener which pierces the merchandise 13 and enters into and is gripped by the pin-receiving member 10.

The member 10 may be a molded plastic assembly which contains a resonant electrical circuit. This circuit cooperates with electronic detecting equipment such as shown in U.S. Pat. No. 3,500,373 so that the equipment produces an alarm signal whenever the merchandise 13 bearing device 1 is brought through a special checkpoint or interrogation region. When a legitimate purchase is made, device 1 is removed by means of a special tool and the merchandise then can be brought through the checkpoint without setting of the alarm. Pin-receiving member 10, as shown in FIG. 1, is formed of upper and lower molded plastic sections 16 and 18 of disc-like configuration laminated to each other. In the center of the upper section 16 there is formed a dome shaped lock housing 20 which contains a mechanism for gripping the pin member 14. Note that pin member 14 in turn is made up of a crown shaped head 22 and a thin elongated shank 24 with a pointed tip 26. As can be seen, the shank passes through the article of merchandise 13 and passes through fluid-containing member 12 into the center of the pin-receiving member 10; and it is held tightly by the locking mechanism inside the lock housing 20.

Figure 2:
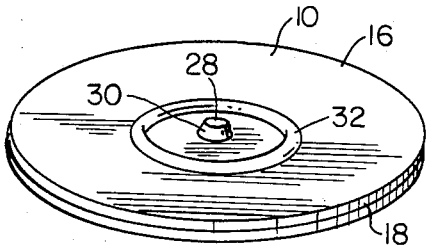
FIG. 2 shows the underside of a pin-receiving member of the device shown in FIG. 1.

FIG. 2 shows the underside of the pin-receiving member 10 is also generally flat except that it contains a central opening 28 for receiving the fastener shank 24, and a rounded dome-like projection 30, which surrounds the opening 28. In addition, a rounded ridge 32 extends circularly around the projection 30. This particular configuration is a matter of choice, and, in this embodiment, utilizes the configuration illustrated in U.S. Pat. No. 4,187,509, issued to Arnold Weiner on Feb. 5, 1980, entitled "Wafer and Fastener For Use in Electronic Theft Detection System", which patent is incorporated herein by reference.

Figure 3:
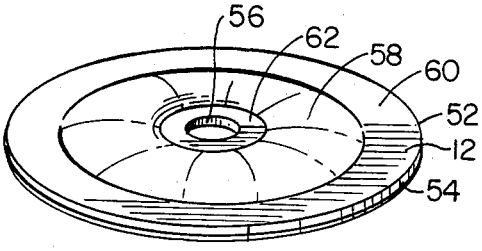
FIG. 3 illustrates a fluid-containing member of the device shown in FIG. 1.

FIG. 3 shows a perspective view of fluid-containing member 12 of device 1 shown above. Fluid-containing member 12 is made of two thin sheets of laminated plastic 52 and 54, aperture 56 and fluid-containing portions, in this case doughnut 58. Flat annuli 60 and 62 act to seal the fluid within doughnut 58. The laminated plastic 52 and 54 are of a predetermined thickness and strength such that the lamination would break and the fluid would be released upon application of a predetermined force thereto, i.e. it would be stong enough to withstand the assembly of the device 1 on merchandise 13 but would break open if force were used to try to remove device 1 from merchandise 13.

The device 1 could be varied in many ways. For example, fluid-containing member 12 could be an integral part of pin-receiving member 10 or pin member 14, e.g. by direct lamination. Also, the device could have any configuration, e.g. square instead of round, and the fastening mechanism and electronics could be any available or known.

The fluid used in the fluid-containing member 12 could be a liquid, a gas or a mixture of these. It could be a dye, or any other colorant, e.g. a coloring agent which reacts the skin but does not color merchandise, an odor-containing gas or liquid, e.g. skunk oil, perfume, or the like, or one with an odor detectable by dogs or electronic sniffers; it could be a flourescent or phosphorescent dye or a radioactive material. Preferably, the fluid is one which minimizes risk but functions to identify a thief or an attempted theft. These preferred fluids would be the various dyes and/or odor-containing fluids.

Figure 4:
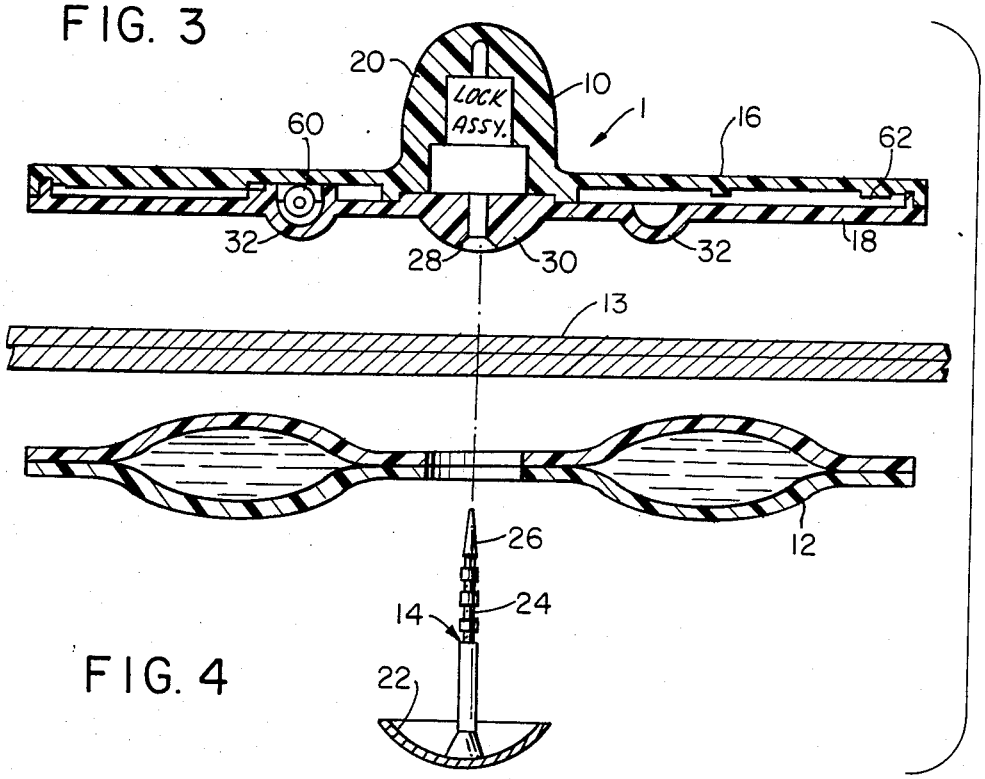
FIG. 4 shows a blown, side cut view of a three member device of the present invention of the type shown in FIG. 1.

FIG. 4 shows a cross-sectional side, blown-cut view of device 1, except that pin member 14 and fluid containing member 12 are both on the underside of merchandise 13. The fluid-containing member 12, thus could be on top of merchandise 13 and under pin-receiving receiving member 10, as shown in FIG. 1, or vice versa, as shown here. Like parts are like numbered, and electronics assembly 60 and 62 are shown as illustrating the location of prior art electronics components for the alarm actuating mechanism.

Figure 5:
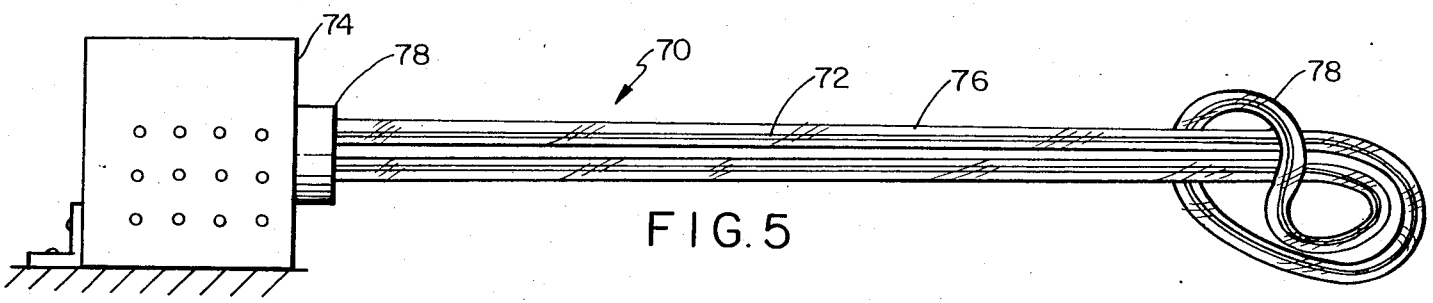
FIG. 5 presents an electronic security device with a fluid-containing member.

In FIG. 5, an electronic security device 70 is shown, which includes an electrical circuit member 72, an electronic signal alarm 74 and a fluid-containing member 76. Device 70 is generally lassoed about itself at end 78 as it is passed through merchandise (not shown) such as the closed handle of a power tool or the sleeve of a mink coat. Device 70 has a plug 78 and after the device 70 is looped or lassoed onto a piece of merchandise, it is plugged into electronic signal alarm 74, which is then actuated. Unplugging before deactivating (e.g. by key) or cutting the electronic circuit member 72 causes an alarm to be sounded. Here, electronic circuit member 72 is loosely held within fluid-containing member 76. In this case, fluid-containing member 76 is a continuous, hollow plastic tube (shown here to be clear plastic, for illustration) which is laminated to itself along its section which is not opened, as shown. Within fluid-containing member 76 is a strong odor-based fluid, such as skunk oil or perfume. When a thief cuts through, the alarm will be sounded and the fluid released. If an attendant does not get to the freed merchandise quickly enough, the odor will reveal the thief's location, thus giving multiple protection. The fluid could, in the alternative, be any marking or identifying fluid such as is described above.

Figure 6:
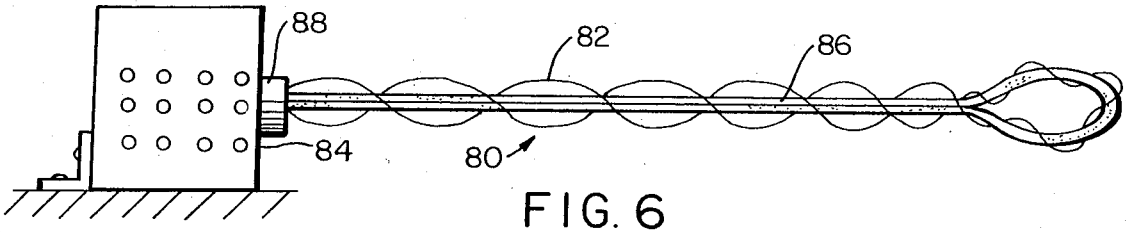
FIG. 6 shows an alternative electronic security device of the present invention.

FIG. 6 shows a device 80 similar to that of device 70 in FIG. 5, except that the various members are separate. Here, electrical circuit member 82 is outside of and wrapped around fluid-containing member 86. The electrical circuit member 82 is plugged into alarm 84 by plug 88 and fluid-containing member 86 may be glued, tied or otherwise attached to the electrical circuit member 82 at or about the plug 88 location. Device 80 works in a fashion similar to device 70 discussed above.

Figure 7:
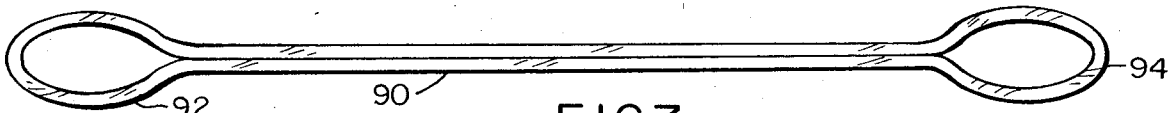
FIG. 7 shows a physical restraining security device with an integrated fluid-containing member; and, FIG. 8 shows an alternative physical restraining security device with a separate fluid-containing member.

FIG. 7 shows a physical restraining security device 90 which is made of very strong tubular plastic and has open loops 92 and 94. In this case loop 92 of device 90 may be passed through a sleeve of a garment, a handle, or a bike wheel etc., and then pass through loop 94 to lasso the merchandise and then loop 92 may be locked to a firm surface with a lock and key. If a thief tries to steal the merchandise, the strong plastic tubing acts to physically restrain the merchandise. However, if a predetermined force is exceeded, e.g. by pulling or cutting, then the tubing breaks and the fluid released marks the merchandise and/or thief.

Figure 8:
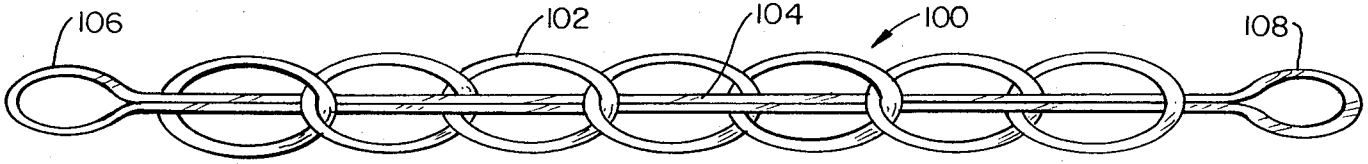

FIG. 8 shows a physical restraining device 100 with a physical restraining member 102 (a chain) and fluid-containing member 104, which has loops 106 and 108, as shown. Both the (chain) member 102 and the fluid-containing member 104 are used as a chain would normally be used to secure merchandise. If the chain is cut or broken, then the released fluid acts as a secondary means of security.

Obviously, numerous modifications and variations of the present invention are possible in light of the above teachings. It is therefore to be understood that the within the scope of the appended claims, the invention may be practiced otherwise than as specifically described herein. For example, the device described in conjunction with FIG. 1 could be modified so that crown-shaped head 22 of pin member 14 could have the fluid containing component as an integral part thereof.

In other words, a pin head to such a security device could itself be breakable with a marking or odor producing fluid contained therein.

Likewise, the remote signal-actuating mechanism could constitute a magnetic material placed within the fluid containing member. Yet another alternative would be the use of odor-containing solid within the fluid-containing member. Thus, solids impregnated with scent, i.e. vaporizable fluid, could be used.

Another feature of the present invention is that these devices maybe substituted with dummy systems which appear to be the same as true systems. Thus, in place of fluids with a distinctly noticeable quality, these dummies would contain innocuous fluids such as air or water.

Many other variations to the present invention should now be obvious to the artisan without exceeding the scope of the present invention.

What is claimed is:

1. An electronic security device which comprises:

(a) An electrical circuit member having a circuit which is capable of actuating a signal alarm upon being cut, said electrical circuit member being releasably attachable to merchandise;

(b) An electronic signal alarm attached to said electrical circuit member and actuated by the cutting of said electrical circuit member; and, (c) A fluid-containing member which fully encapsulates a fluid having a distinctly noticeable quality, said fluid-containing member being breakable so as to release said fluid in response to a predetermined force, said fluid-containing member being a plastic tube which includes said electrical circuit member contained therein.

2. The device of claim 1 wherein said fluid is a gas having a strong odor.

3. The device of claim 1 wherein the fluid is a liquid having a strong odor.

4. The device of claim 1 wherein said fluid contains flourescent marking material.

5. The device of claim 1 wherein said fluid contains a distinctive coloring agent.

* * * * *